United States Patent [19]

Dorau et al.

[11] Patent Number: 4,582,045

[45] Date of Patent: Apr. 15, 1986

[54] HEATING APPARATUS

[76] Inventors: Warren G. Dorau, 122 Lakeview Dr., Crandon, Wis. 54520; Colin C. Handeyside, P.O. Box 127, Elcho, Wis. 54428; Lynn N. Kramar, Box 94, Crandon, Wis. 54520

[21] Appl. No.: 331,519

[22] Filed: Dec. 17, 1981

[51] Int. Cl.[4] ..... F24C 1/14

[52] U.S. Cl. ..... 126/290; 126/77; 126/286; 110/203

[58] Field of Search ..... 126/77, 112, 287, 286, 126/290; 110/203; 422/177, 181

[56] References Cited

U.S. PATENT DOCUMENTS

| | | | |
|---|---|---|---|
| 2,112,272 | 3/1938 | DeLin | 126/287 |
| 2,367,165 | 1/1945 | Astradsson | 126/290 X |
| 2,524,868 | 10/1950 | Worsham | 126/286 X |
| 2,638,892 | 5/1953 | Hammond et al. | 126/286 |
| 2,709,551 | 5/1955 | Bower et al. | 126/77 X |
| 2,845,882 | 8/1958 | Bratton | 110/8 A |
| 3,084,683 | 4/1963 | Gilbertson | 126/290 |
| 3,130,961 | 4/1964 | Verner | 110/203 |
| 4,054,418 | 10/1977 | Miller | 110/203 |
| 4,184,473 | 1/1980 | McIntire et al. | 126/77 |
| 4,316,444 | 2/1982 | Gullickson | 126/77 |
| 4,319,556 | 3/1982 | Schwartz | 110/203 |
| 4,330,503 | 5/1982 | Allaire | 422/177 |
| 4,345,528 | 8/1982 | Allaire | 110/203 |
| 4,373,507 | 2/1983 | Schwartz | 126/289 |
| 4,383,517 | 5/1983 | Gillis et al. | 126/77 X |
| 4,437,451 | 3/1984 | Wysong | 126/77 |
| 4,458,662 | 7/1984 | Barnett | 126/77 |

FOREIGN PATENT DOCUMENTS 133704 1/1979 Fed. Rep. of Germany ..... 110/203

*Primary Examiner*—Samuel Scott
*Assistant Examiner*—Carl D. Price
*Attorney, Agent, or Firm*—Walter B. Udell

[57] ABSTRACT

A wood or coal burning heater or stove employing a catalytic combustor in its combustion chamber having a primary air supply which feeds air to the fuel, and a secondary air supply which feeds air directly to the catalytic combustor by means of an air diffuser which sprays air evenly over the undersurface of the catalytic combustor. Combustion gases from the burning fuel in the combustion chamber pass through the catalytic combustor to a heat exchanger and then to an exhaust flue. The primary and secondary air supplies are simultaneously controlled so that maximum primary air and reduced secondary air are supplied when maximum heat is demanded, and reduced primary air and maximum secondary air are supplied when minimum heat is demanded. The ratio of primary to secondary air is precisely controlled to maximize overall heating efficiency consonant with high BTU output. A safety interlock system is also provided which only permits opening of the fuel loading door to the combustion chamber after first opening an internal path from the combustion chamber to the exhaust flue which by-passes the catalytic combustor, and maximizing the primary air supply, to thereby prevent the flow of combustion products out of the fuel loading door.

8 Claims, 9 Drawing Figures

FIG.6
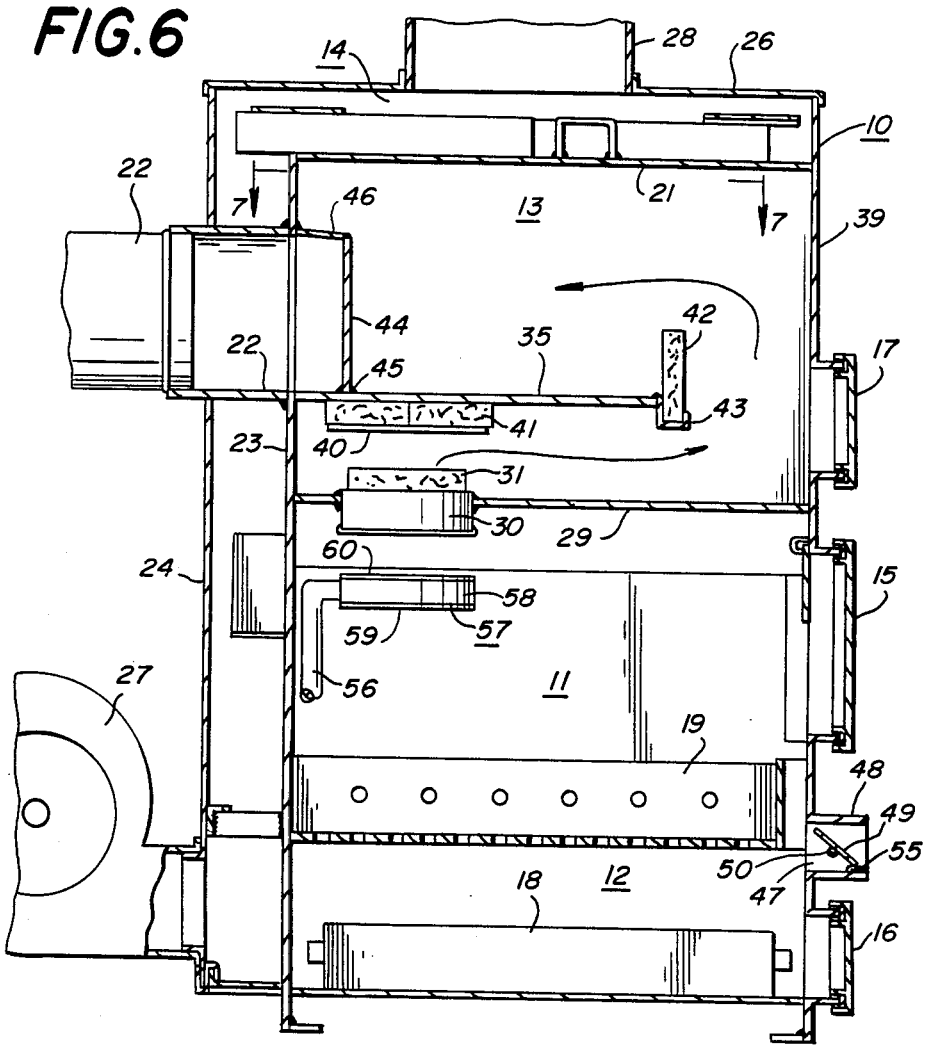
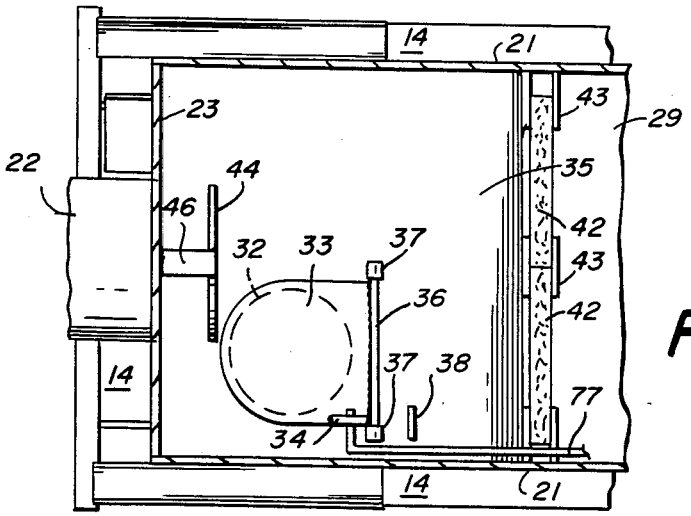
FIG.7

FIG. 8
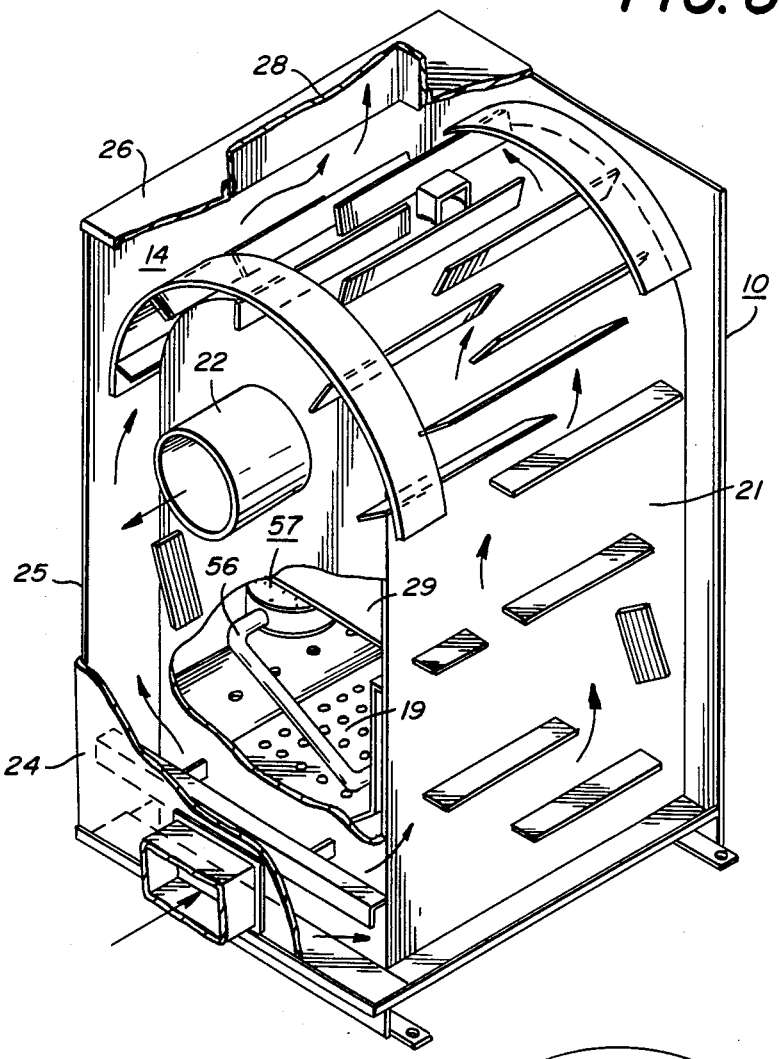
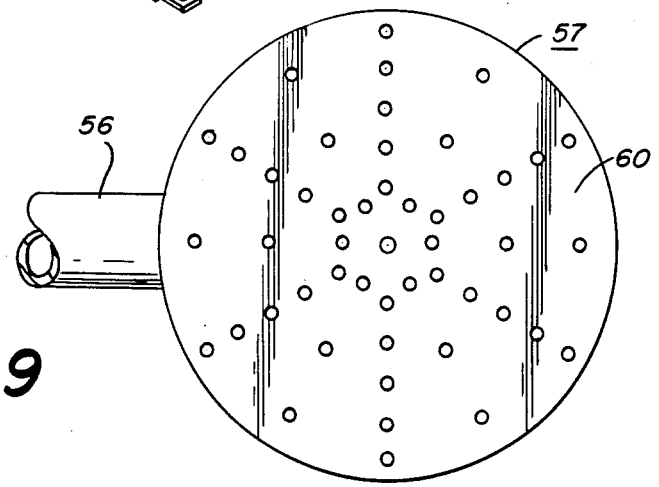
FIG.9

HEATING APPARATUS

BACKGROUND OF THE INVENTION

This invention relates to an improved heater or stove for burning bio-mass fuel such as wood or coal. More particularly it relates to heaters or stoves employing an improved catalytic combustor system which materially increases heating efficiency by aiding in the fuel combustion, and to cause removal of dangerous and undesirable by-produces in the exhaust from the heater or stove.

Wood and coal burning heaters and stoves are not new, but recently efforts have been made to improve their efficiency and safety due to the increased demand for this type of device because of the large increases in price of other fuels such as gas and oil. One such improvement has been the incorporation of catalytic combustors in wood burning heaters and stoves. The catalytic combustor is a honeycomb type cellular structure of porous ceramic coated with a catalyst composed of noble metals. Smoke produced by the burning of the fuel passes through the catalytic combustor before entering the exhaust flue of the furnace.

The use of a catalytic combustor provides at least two advantages. Firstly, the efficiency is increased because the catalytic combustor causes heretofore unburned products of combustion to be burned. Heat produced from the burning of such unburned products of combustion provides an additional output from the stove and increases the heating efficiency. Secondly, unburned gases when cooled down in the chimney form flammable creosote deposits on the inside surface of the chimney and present a significant danger in causing chimney fires. By employing a catalytic combustor the amount of unburned gases and smoke released to the chimney associated with the heater or stove is reduced.

SUMMARY OF THE INVENTION

The invention herein described improves the efficiency and safety of furnaces employing catalytic combustors by simultaneously controlling the supply of air which is fed to the fuel in the furnace via a first or primary air passage and directly to the catalytic combustor via a secondary air passage. In operation, when the furnace is banked, the amount of air allowed to reach the fuel via the primary air supply is reduced, and consequently more smoke containing unburned hydrocarbons is produced in the firebox. At the same time, the volume of air allowed to reach the catalytic combustor via the secondary air supply is increased, so that the catalytic combustor can cause the increased amount of unburned products to be consumed.

Conversely, when the stove is called upon to produce more heat, more air is permitted to flow to the burning fuel via the primary air supply and more complete combustion takes place. At this time the flow of air to the catalytic combustor via the secondary air supply is reduced since the amount of unburned material reaching the catalytic combustor is reduced, and the amount of air needed for the catalytic combustor to operate efficiently is also reduced.

In the preferred embodiment of this invention, as illustrated and described herein embodied in a wood burning furnace, air flowing to the secondary air supply is not only controlled as described above, but the air out of the secondary air supply is directly distributed over substantially the entire under surface of the catalytic combustor to maximize its effectiveness.

Further, not only is the efficiency and safety of the furnace enhanced by controlling the flow of air through the primary and secondary air supplies as described herein during normal operation, but also when refueling the furnace the air fed by the primary air supply to the fuel is maximized, the air fed to the catalytic combustor by the secondary air supply is reduced, and a by-pass from the combustion chamber to the flue is opened, whereby the smoke in the furnace directly flows to the flue. Before the fuel door to the firebox is unlocked and can be opened by the operator the maximum air through the first air supply carries any smoke away to the chimney via the open by-pass so that the smoke in the furnace goes out the exhaust system instead of into the air adjacent to the furnace when the fuel door is open. During the time the fuel door is open the by-pass remains open, and after the fuel door is closed the by-pass to the chimney is closed and the door is locked.

Accordingly it is an object of this invention to improve the efficiency and safety of wood burning heaters and stoves.

Another object of this invention is to provide an improved wood burning furnace which has first and second combustion air supplies which are simultaneously controlled.

A more particular object of this invention is to provide an improved wood or coal burning device which has a catalytic combustor and first and second combustion air supplies, wherein the first air supply provides air for the combustion of fuel in the combustion chamber and the secondary air supply provides air for the catalytic combustor, and wherein said air supplies are simultaneously controlled in a particular way to increase the efficiency of the device.

Another object of this invention is to provide in a heating device which includes a catalytic combustor, by-pass apparatus for discharging combustion products to a flue prior to opening the fuel loading door of the device, thereby preventing the discharge of the combustion products out of the device via the fuel loading door.

A more particular object of this invention is to provide in a wood or coal burning device which includes a catalytic combustor, by-pass apparatus of the type described above which includes an interlocked control for the primary and secondary air supplies which supply air to the fuel and the catalytic combustor.

The foregoing and other objects of the invention will become apparent from a reading of the specification and from the appended claims when read in conjunction with the following drawings, wherein:

BRIEF DESCRIPTION OF THE DRAWINGS

FIG. 6 is a side sectional view taken substantially through a plane indicated by section line 6—6 in FIG. 4;

FIG. 7 is a horizontal sectional view through the illustrated furnace as would be seen when viewed along line 7—7 in FIG. 6;

FIG. 8 is an isometric drawing of the furnace with parts of the outer shell sectioned away illustrating the path of the air to be heated; and FIG. 9 is a view of the air diffuser portion of the secondary air supply.

DESCRIPTION OF THE PREFERRED EMBODIMENT

Figure 1:
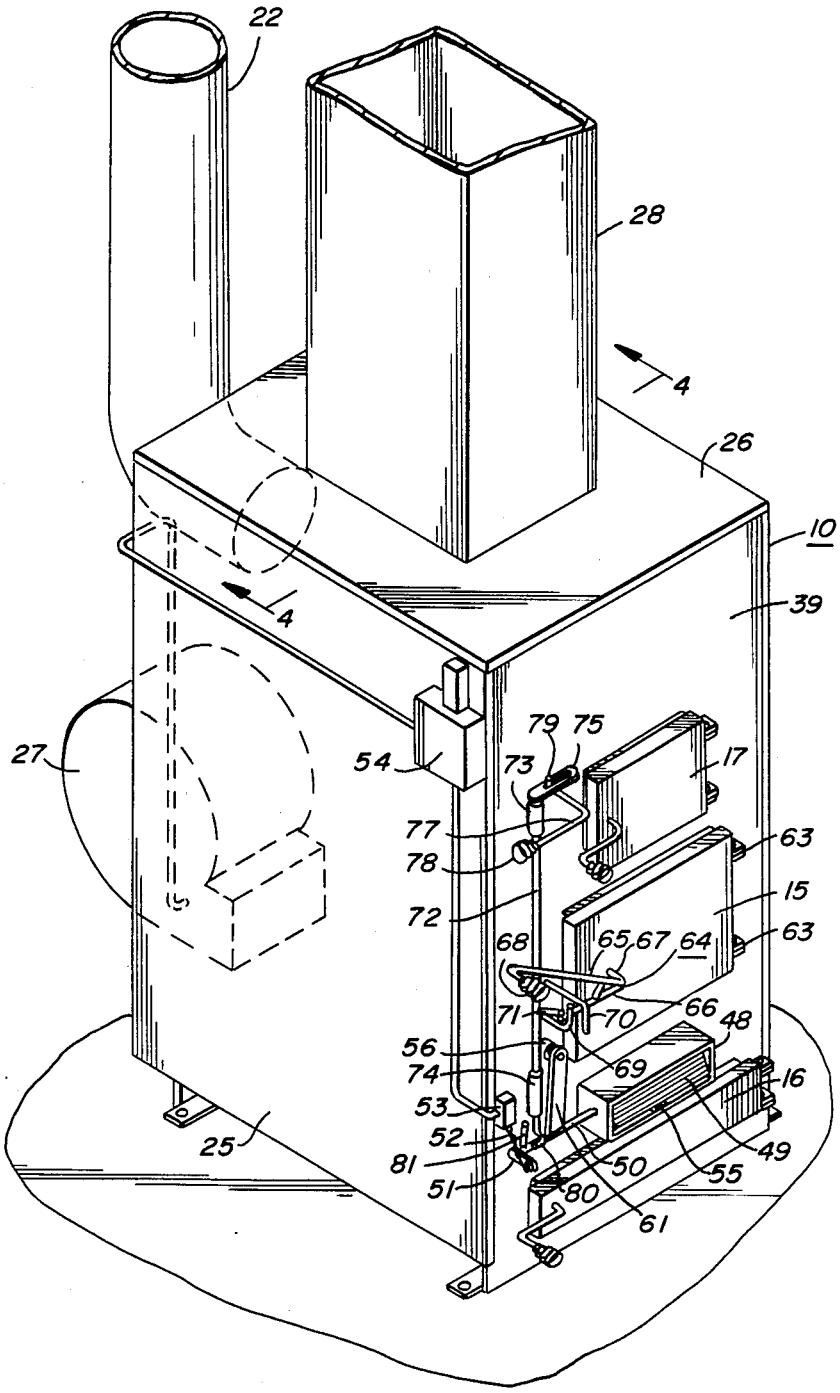
FIG. 1 is a perspective view illustrating a furnace constructed in accordance with the present invention.

In the several figures, like elements are denoted by like reference characters.

Figure 4:
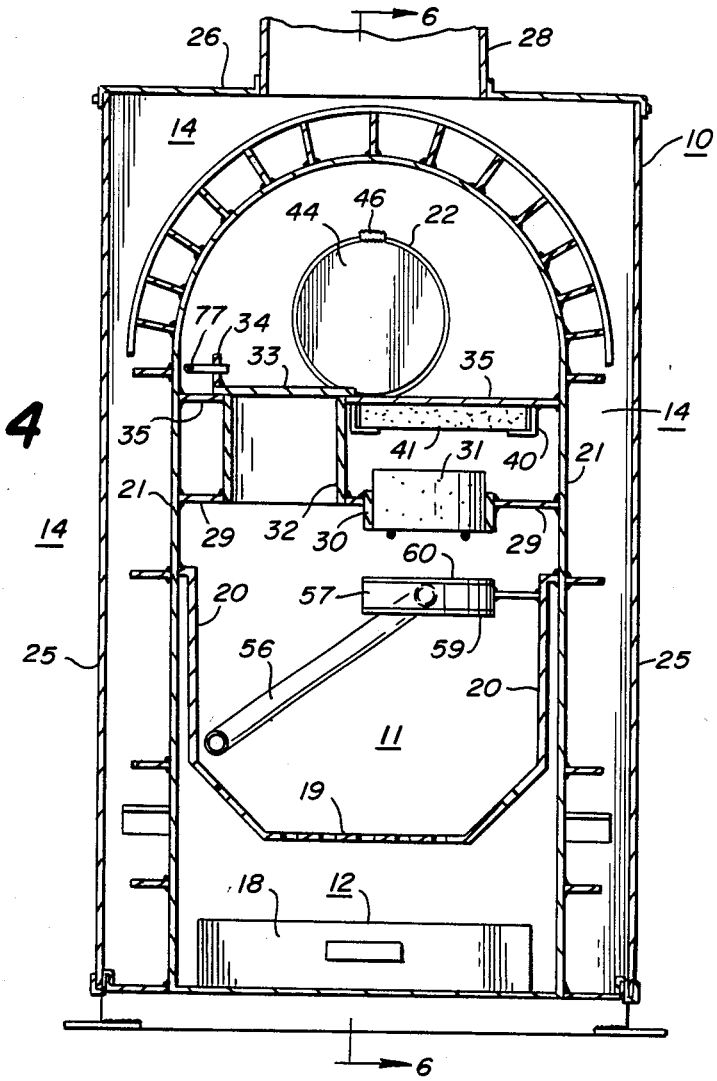
FIG. 4 is a front sectional view of the furnace taken substantially through a plane indicated by section line 4—4 in FIG. 1.

Referring now to the figures and first to FIGS. 1, 4 and 6, there is shown a furnace 10 having a fuel combustion chamber or firebox 11, an ash pit 12 beneath the firebox, a heat exchanger chamber 13 above the firebox, and a hot air plenum 14 above and around the sides and back of the heat exchanger and firebox. Access to the firebox 11 is had through a fuel loading door 15, while access to the ash pit and heat exchanger chambers 12 and 13 is by means of doors 16 and 17 respectively. An ash tray 18 is seated in the ash pit 12 behind door 16 and directly below the wood supporting combustion grate 19 which forms the floor of the firebox and separates the latter from the ash pit 12. The metal forming the grate 19 also forms the upturned sidewalls 20 of the firebox which are rigidly secured to the inverted U-shaped interior wall 21 of the furnace, which latter forms also the sidewalls and top of the heat exchanger chamber 13.

A flue 22 extends from the rear of the heat exchanger 13 through internal rear wall 23 and external rear wall 24 of the furnace for discharging the combustion products to the chimney. The rear walls 23 and 24 form the rear section of the plenum. The side and top sections of the plenum 14 are formed by the interior furnace wall 21 with the exterior sides and top walls 25 and 26. An electrically driven centrifugal air blower 27 is mounted to the rear wall 24 to blow air to be heated upward through the rear, sides and top sections of the plenum 14 for discharge through the top hot air exit duct 28.

The firebox 11 is completely separated from the heat exchanger chamber 13 by a horizontal plate or partition 29 apertured to provide openings therethrough into which are respectively fixed a holder 30 for a removable catalytic combustor 31 and a hollow cylindrical by-pass section 32 open at its lower and upper ends. The upper end of the by-pass 32 is normally sealed by a cover plate 33 which is openable under conditions to be subsequently described to permit the combustion products from the firebox 11 to be directly routed to the flue 22, whereas under normal operating conditions the combustion products must pass through the catalytic combustor 31 to reach the flue.

Figure 2:
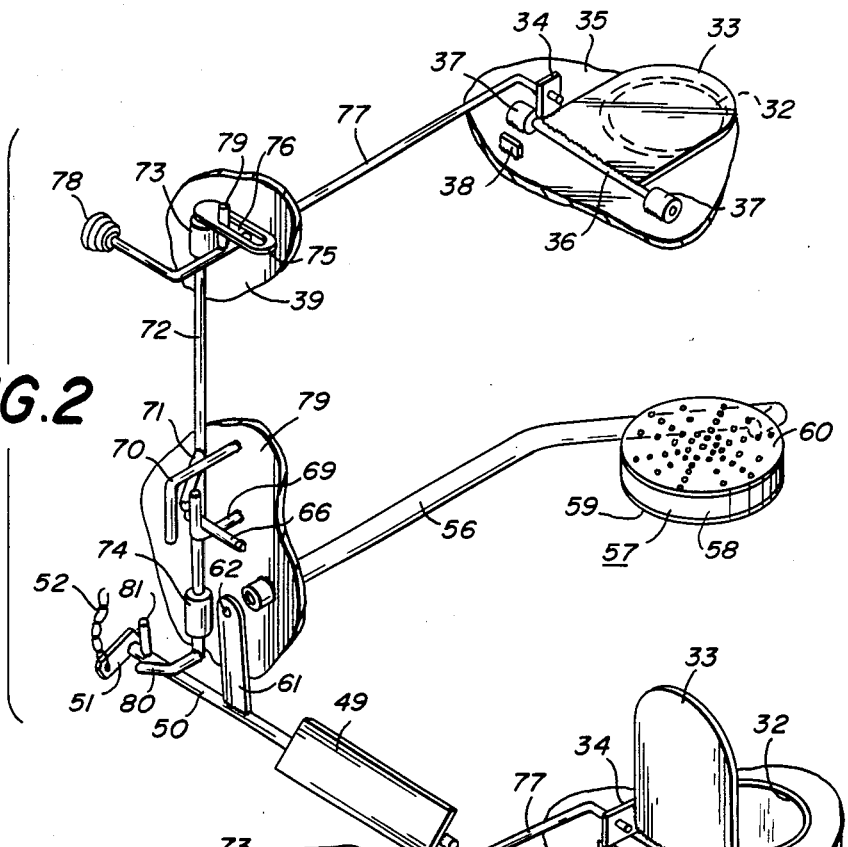
FIG. 2 illustrates the fuel loading safety interlock system showing the condition of the primary and secondary air supplies when the flue by-pass apparatus is in the closed position and the fuel door is locked.
Figure 3:
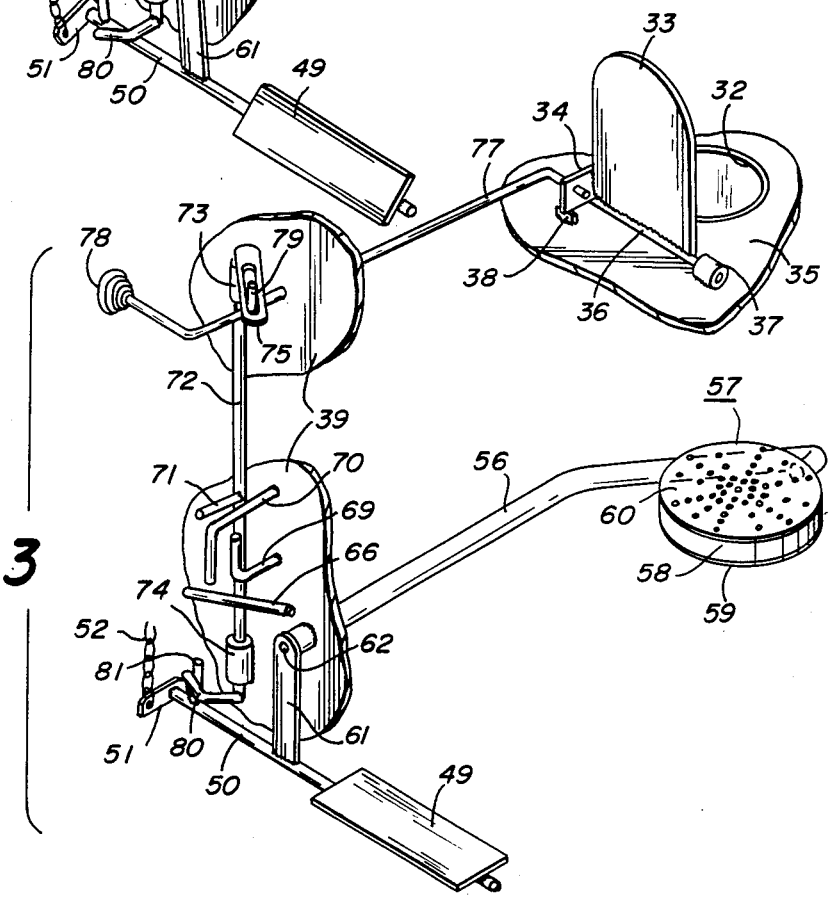
FIG. 3 illustrates the fuel loading safety interlock system showing the condition of the primary and secondary air supplies when the flue by-pass apparatus is in the opened position and the fuel door is unlocked.

The by-pass cover plate 33 has secured thereto a tab 34, which forms part of an activating mechanism to be subsequently described in connection with FIGS. 1, 2 and 3, by means of which the cover plate is raised and lowered to open and close the by-pass 32. The cover plate 33, as best seen in FIGS. 2, 3, 4 and 7, is hingedly secured to the top surface of a heat exchanger chamber shelf 35 by means of a pivot shaft 36 and shaft bearings 37, and a stop 38 is provided to limit the opening movement of the cover plate by engagement with the tab 34.

The shelf 35 extends the full width of the heat exchanger compartment from the rear wall 23 forward approximately three fourths of the distance to the furnace front wall 39, as best seen in FIGS. 4, 6 and 7. Removably held to the underside of shelf 35 directly over the catalytic combustor 31 by brackets 40 are firebricks 41 which prevent damage to shelf 35 from the intense heat generated by the catalytic combustor as the combustion products pass upward therethrough. Similarly, a pair of firebricks 42 are held as shown in FIGS. 6 and 7 at the front edge of shelf 35 by brackets 43. Positioned in front of the flue opening and spaced forward therefrom is a circular baffle plate 44 fixed at its bottom to the shelf 35 by a weld 45, and positionally fixed at the top by a spacer bar 46 which extends from the rear wall 23.

From the arrangement shown it will be understood that the combustion products normally pass through the catalytic combustor 31, travel forward beneath the shelf 35, upward around the firebricks 42 and rearward over the shelf 35, spreading laterally and upward so as to flow around the baffle 44, and finally exiting through the flue 22. The shelf 35 and baffle 44 extend the flow path and reduce the flow rate so that the hot combustion products remain for a longer time in contact with the walls of the heat exchanger chamber so that the maximum heat may be transmitted to the surrounding plenums 14.

This effectively causes a back pressure which can cause dangerous consequences if the fuel loading door is opened while such conditions exist, and for this reason the by-pass arrangement best seen in FIGS. 4 and 7 is provided to create when needed a low resistance easy flow path to the flue for the combustion products from the firebox whenever the fuel loading door is to be opened. This low resistance flow path is created by positioning the by-pass immediately adjacent to the flue opening and thereby short-circuiting the relatively high resistance flow path through the catalytic combustor and around the shelf 35.

The furnace is provided with a primary air supply which feeds the combustion of fuel in the firebox, and with a secondary air supply which is fed directly to the catalytic combustor 31. These two air supplies, to now be described, are simultaneously modulated in accordance with the heat demand from the furnace in a manner which by the utilization of relatively simple and inexpensive means provides extremely high heating efficiencies heretofore not achievable in commercially available heating systems.

The primary air supply, as best seen in FIGS. 1, 2 and 6 consists of a rectangular opening 47 through the front wall of the furnace into which is fitted a short rectangular duct section 48 extending forward from the furnace front wall. Positioned within the duct 48 is a rectangular plate or vane 49 fixed to and rotatable with a pivot shaft 50 so as to form a butterfly valve or damper with the duct 48 for controlling the air flow through the duct. The pivot shaft 50 extends to the left and has secured to its free end one end of a crank arm 51 the other end of which is connected to the lower end of a chain 52 which has its upper end connected to the plunger of a solenoid 53. The solenoid 53 is actuated and deactuated by a thermostat (not shown) through a junction box and blower control 54 which controls the activation and deactivation of the blower 27.

When the thermostat calls for heat the solenoid 53 is actuated to pull up on the chain 52 to thereby rotate the damper vane 49 into its horizontal position to maximally open the damper to provide maximum combustion air intake beneath the grate 19 to the wood fuel in the firebox, and turning on the blower 27 when the plenum temperature has risen to a set point. Conversely, when the heat demand has been satisfied, the thermostat deactivates the solenoid 53 thereby causing the chain 52 to relax and permitting the pivot shaft 50 and damper vane 49 to rotate back to its previous condition in which the primary air is substantially reduced to thereby decrease fuel consumption. A vane stop 55 is provided on the bottom of the duct 48 to prevent the damper vane 49 from closing the primary air intake beyond that desired. The blower is deactivated when the plenum temperature falls to a preset point.

The secondary air supply, as seen in FIGS. 2, 3, 4, 6 and 8, consists of a pipe 56 which has its front end open to the atmosphere and positioned to the left and above the primary air supply intake, and from which point it extends through the furnace front wall 39 rearward through the firebox 11 along one side wall 20 to the rear wall 23 and upward therealong to a connection at the back of a hollow air diffuser 57 positioned directly beneath the catalytic combustor 31. The air diffuser 57 distributes the air flowing through secondary air supply pipe 56 evenly across the underside of the catalytic combustor.

The air diffuser is generally circularly cylindrical in shape and slightly larger in diameter than the cataytic combustor, has an imperforate sidewall 58 and bottom plate 59, and a perforated top plate 60. The perforation pattern shown in FIG. 9 for top plate 60 was determined empirically and has been found to be most effective in the disclosed embodiment of the invention which has been extensively tested, although it may be found that other diffusion patterns may be effective in different embodiments.

The effectiveness of a catalytic combustor is greatly affected by the amount of air available to it during the catalyzing process. In the past, the air supplied to the catalytic combustor has been that which has been available within the firebox and was thus derived almost entirely from the primary air supply, some additional air being sometimes drawn in around doors or windows in the unit. The amount of air available to the catalytic combustor was therefore quite variable as a function of the rate of combustion occurring in the firebox and the primary air supply setting. This seriously impaired the efficiency of the catalytic combustor.

In the system according to the invention the addition of the secondary air supply which conducts air directly to the catalytic combustor effects a substantial improvement in the catalyzing efficiency of the combustor. Additionally, as will be now described, a further substantial improvement in efficiency has been effected by controlling the volume of air flow through the secondary air supply in accordance with the volume of air flow through the primary air supply.

This control on the secondary air supply is best seen by reference to FIGS. 1, 2 and 3, wherein it is seen that an elongated damper plate 61 is fixed at its lower end to the pivot shaft 50 and extends upward so that its upper end is flatwise disposable against the open end of secondary air supply pipe 56 when the pivot shaft 50 has rotated the damper vane 49 into its maximum open position, as shown in FIG. 3. A hole or aperture 62 through the damper plate 61 coincides with the open end of the pipe 56 so that as shown in FIG. 3 the air admission to the pipe is reduced in accordance with the area of the hole 62 as compared with the open cross sectional area of the pipe. When the pivot shaft 50 is rotated as seen in FIG. 2 so that the primary air supply is reduced by damper vane 49 it is seen that damper plate 61 is displaced from covering the open end of pipe 56 and the full cross-sectional area of the pipe is open for carrying secondary air.

From the foregoing it is to be understood that when primary air is maximized secondary air is reduced, and that when primary air is reduced secondary air is maximized. In a furnace which has been constructed in accordance with the principles of the invention it has been found through testing that for that particular construction maximum efficiencies were achieved by reducing the secondary air during periods of maximum primary air delivery to one-fourth of that available during periods of minimum primary air delivery. This was achieved by utilizing a pipe 56 having a three quarter inch (¾") inner diameter and a damper plate 61 having a hole 62 of three eighths of an inch (⅜") diameter. Accordingly, the maximum secondary air opening was 0.44 square inches, and the minimum secondary air opening was 0.11 square inches.

The primary air duct 48 and damper vane 49 are constructed so that in the maximum open position there exists a one half inch (½") vertical opening, and in the minimum open position there exists a three sixteenths inch (3/16") vertical opening. The horizontal length of the primary air intake duct was nine and one-half inches (9½") so that the primary air opening at maximum was approximately four and three quarters square inches and at minimum was approximately one and three quarters square inches. Accordingly, the ratio between maximum and minimum primary air under these conditions was substantially eight to three (8:3). The ratio of primary air opening to secondary air opening during high heat demand periods was substantially 43 to 1, while this ratio during low heat demand periods was substantially 4 to 1. This shows a relative proportioning shift of substantially 11 to 1.

The improvements effected by the invention are clearly shown from test data obtained from operation of a wood burning furnace constructed in accordance with the invention, such data being shown in Table 1 below. In all cases the same furnace was used, the only differences being the presence or absence of secondary air and the proportioning of secondary air to primary air.

| | PERCENT COMBUSTION EFFICIENCY | PERCENT OVERALL HEATING EFFICIENCY |
|---|---|---|
| Primary Air Only (No Secondary Air) | 81.2 | 75.2 |
| Primary Air with Constant Secondary Air | 94.6 | 84.4 |
| Modulated Primary and Secondary Air | 98.3 | 88.6 |

From the test data it is evident that dramatic efficiency gains are realized firstly by the addition of secondary air conducted directly to the catalytic combustor, and secondly by modulating the secondary air with respect to the primary air.

When the furnace has been operated for some time, it will be necessary to add fuel. Ordinarily, this would be done by opening the fuel loading door 15 and inserting more fuel. However, this procedure involves certain risks, namely, that the combination products in the firebox will come out the front of the furnace when the door 15 is opened, or worse, due to the pressure in the firebox relative to the ambient pressure flames may leap out of firebox toward the furnace operator. To alleviate this risk, fuel loading door 15 is rendered unopenable by an interlock system until the smoke and pressure inside the firebox is safely reduced. This safety interlock system involves control of the primary and secondary air supplies in conjunction with operation of the by-pass cover plate 33, and is best seen by reference to FIGS. 1, 2, 3, 5 and 7.

Figure 5:
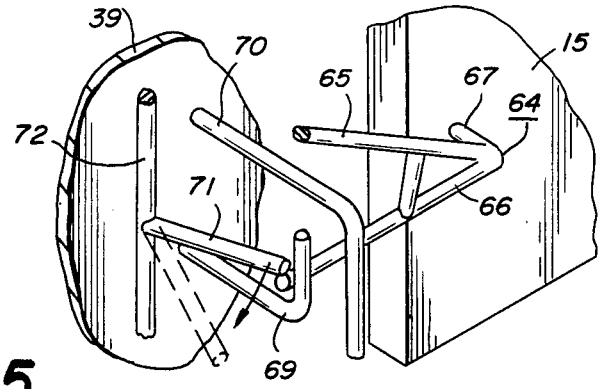
FIG. 5 illustrates the fuel door locking mechanism.

The fuel loading door 15 is hingedly secured at one side to the front 39 of the furnace 10 by a pair of hinges 63, and is latch locked at the other side by a generally V-shaped pivot latch 64 most clearly shown in FIG. 5. The pivot latch 64 includes an upper leg 65 and a lower leg 66 which converge to form the vertex of a V, and from which vertex there extends orthogonally into the door 15 a pivot leg 67 which is rotatably journalled in the door. The upper leg 65 carries the latch operator 68 while it is the free end of lower leg 66 which provides the door latch function by engagement behind the upstanding leg of L-shaped member 69 which latter is fixedly secured to the front 39 of the furnace. The engagement of leg 66 behind the upstanding leg of member 69 secures fuel door 15 in its locked closed position. Opening of fuel door 15 requires clockwise rotation of the latch 64 about pivot leg 67 to a sufficient degree to cause the end of leg 66 to clear the top of the upstanding leg of L-shaped member 69 and move forward and downward to clear the bottom end of the downturned leg of L-shaped member 70 which is also fixedly secured to the front 39 of furnace 10. This opening movement of latch leg 66 is normally prevented by a locking bar 71 which overlies the free end of latch leg 66 and which is part of the safety interlock.

Locking bar 71 is connected to a rotatable vertical shaft 72 which passes through bearings 73 and 74 secured to the front wall 39 of the furnace. The upper end of shaft 72 is fixed to one end of an elongated horizontal flat bar 75 which has a vertical slot 76 therethrough for most of the length of the bar almost to the free end thereof. The rod 71 and elongated member 75 are fixedly secured to the vertical shaft 72 so that when the rod 71 overlies latch leg 66 the member 75 extends substantially parallel to the front 39 of the furnace. A push rod 77 immediately beneath horizontal bar 75 extends horizontally rearward through the front wall 39 into the heat exchanger 13 and pivotally connects to tab 34 secured to the movable by-pass cover plate 33. When push rod 77 is pulled axially forward by operation 78, cover plate 33 is raised to open the by-pass 32, and when the push rod is pushed axially rearward the cover plate 33 is lowered to close the by-pass 32.

A pin 79 fixed to the forward end of push rod 77 extends upward through the slot 76 in bar 75 so that the pin 79 is at the slot end closest to bearing 73 when the by-pass cover plate 33 is closed and the locking bar 71 overlies fuel door latch leg 66. Affixed to the lower end of rotatable vertical shaft 72 below bearing 74 is an L-shaped arm 80 which, as shown in FIG. 2, extends forward away from the front wall of the furnace and turns laterally toward the left, terminating in a free end. The function of arm 80 is to engage pin 81, which extends upward from air supplies control pivot shaft 50, and move it toward the furnace front wall to rotate pivot shaft 50 into its position causing maximum primary air and reduced secondary air when push rod operator 78 is pulled forward to raise by-pass cover plate 33 prior to opening fuel loading door 15.

Accordingly, it is seen from FIG. 3 that in this forward position of push rod 77 the air transmission condition of the primary air supply is fixed to provide maximum primary air and can not be controlled by the normal thermostatic action through chain 52 and crank arm 51, the by-pass cover plate 33 is raised, and, as best seen from FIGS. 3 and 5, the locking bar 71 has rotated away from its position overlying door latch leg 66 so that the fuel loading door may be opened to add fuel to the firebox.

Thereafter, the door is closed and latched by manipulating the latch 64 so that leg 66 is placed between the vertical legs of members 69 and 70, and moved upward inward and downward behind the upstanding leg of L-shaped member 69 to rest on the horizontal leg of the L-shaped member 69. To lock the door 15, push rod 77 is pushed rearward into the furnace thereby lowering by-pass cover plate 33 and causing vertical shaft 72 to rotate counterclockwise to reposition locking bar 71 over the end of latch lower leg 66, and counter rotate L-shaped arm 80 to disengage it from pin 81 and free pivot shaft 50 so that control of the air supplies is restored to the thermostat.

While the invention has been disclosed in connection with a preferred embodiment thereof, it should be understood that there may be other embodiments which fall within the spirit and scope of the invention as defined by the following claims.

What is claimed as new and useful is:

1. Heating apparatus comprising in combination, (a) a combustion chamber in which fuel is burned, (b) a primary air supply including a first adjustable damper for regulating the volume of primary air transmitted to said combustion chamber for direct combustion of fuel therein, said primary air supply further including stop means engageable by said first damper to cause said first damper to remain partially open when in a first damper maximum closed position, (c) a flue for venting combustion products generated in said combustion chamber, (d) a catalytic combustor having an inlet and an outlet and interposing said combustion chamber and said flue, said inlet communicating with said combustion chamber and said outlet communicating with said flue, so that the combustion products normally pass through said catalytic combustor in order to be vented through said flue, (e) secondary air supply means for supplying secondary combustion air from outside of the heating apparatus directly to said catalytic combustor inlet, said secondary air supply including a second adjustable damper for regulating the volume of air transmitted to said catalytic combustor, whereby the combustion products from said combustion chamber are mixed with said secondary combustion air just before passing into said catalytic combustor, and said second damper including means to maintain a minimum volume of secondary air to said catalytic combustor when said second damper is in a second damper maximum closed position, (f) control means coupled to both of said first and second dampers for simultaneously adjusting them to regulate the volume of air transmitted to each of said combustion chamber and said catalytic combustor, said control maximize the air volume transmitted to said combustion chamber while simultaneously acting on said second damper to reduce to a lower volume the air transmitted to said catalytic combustor, and said control means when in a second control state acting on said first damper to reduce to a lower volume the air transmitted to said combustion chamber while simultaneously acting on said second damper to maximize the air volume transmitted to said catalytic combustor, said first and second dampers being fixedly interconnected by rigid means such that each of said first and second dampers in their maximum closed positions remains partially open to deliver a predetermined minimum volume of primary and secondary air respectively to said combustion chamber and said catalytic combustor.

2. Heating apparatus as defined in claim 1 wherein said second damper is arranged to provide a ratio of maximum to minimum secondary air supply to said catalytic combustor in a range of four to one.

3. Heating apparatus as defined in claim 1 wherein said first damper is arranged to provide a ratio of maximum to minimum primary air supply to said combustion chamber in a range of eight to three.

4. Heating apparatus as defined in claim 1 wherein said first and second dampers are arranged so that a ratio of primary air supply to secondary air supply g when the primary air supply is maximized g is in a range of forty three to one, while when the secondary air supply is maximized a ratio is in the range of four to one.

5. Heating apparatus comprising in combination, (a) a combustion chamber in which fuel is burned, (b) a primary air supply for supplying combustion air to the fuel in said combustion chamber, said primary air supply including first airflow regulating means for regulating the volume of air transmitted to said combustion chamber for direct combustion of fuel therein, (c) a flue for venting combustion products generated in said combustion chamber, (d) a catalytic combustor having an inlet and an outlet and interposing said combustion chamber and said flue, said inlet communicating with said combustion chamber and said outlet communicating with said flue, so that the combustion products normally pass through said catalytic combustor in order to be vented through said flue, (e) secondary air supply means for supplying secondary combustion air from outside of the heating apparatus directly to said catalytic combustor inlet, said secondary air supply including second airflow regulating means for regulating the volume of air transmitted to said catalytic combustor, whereby the combustion products from said combustion chamber are mixed with said secondary combustion air just before passing into said catalytic combustor, (f) a heat exchange chamber immediately adjacent to said combustion chamber, the said catalytic combustor outlet exiting into said heat exchanger chamber at a first location, and the entrance to said flue being at a second location in said heat exchanger chamber, whereby, the combustion products and heat which emerge from said catalytic combustor outlet pass through said heat exchanger chamber before exiting into said flue, (g) a by-pass opening between said combustion chamber and said heat exchanger chamber, said by-pass opening into said heat exchanger chamber being located closed to the entrance to said flue, and by-pass opening sealing means effective when actuated to open and closed said by-pass opening, (h) by-pass sealing means control means coupled to said sealing means and extending through said heating apparatus to the exterior thereof, said sealing means control means being effective when actuated in a first way to close and seal said by-pass opening and being effective when actuated in a second way to open said by-pass opening to permit at least most of the combustion products from said combustion chamber to flow directly to said flue without having to pass through said catalytic combustor, (i) an openable and closeably fuel loading door openable from the exterior into said combustion chamber for loading fuel into said chamber, and door latching means effective when latchingly engaged to hold said fuel door in its fully closed position, and (j) interlock means coupled to and actuatable with said by-pass sealing means control means, said interlock means including first and second locking means, said first locking means being effective when said by-pass sealing means control means is actuated in said first way to lock said fuel loading door latching means to prevent operation thereof and thereby prevent said fuel loading door from being opened, and being effective when said by-pass sealing means control means is actuated in said second way to unlock said fuel loading door latching means to permit operation thereof and thereby allow said fuel loading door to be opened, said interlock means second locking means being couplable to and locking said first and second airflow regulating means to maximize primary air transmission and reduce secondary air transmission when said by-pass sealing means control means is actuated in said second way, said second locking means being decoupled from said first and second airflow regulating means when said by-pass sealing means control means is actuated in said first way.

6. Heating apparatus as defined in claim 5 wherein both of said first and second airflow regulating means are adjustable, and further including control means coupled to both of said first and second airflow regulating means for simultaneously adjusting them to simultaneously regulate the volume of air transmitted to each of said combustion chamber and said catalytic combustor.

7. Heating apparatus as defined in claim 5 wherein both of said first and second airflow regulating means are adjustable, and further including control means coupled to both of said first and second airflow regulating means for simultaneously adjusting them to simultaneously regulate the volume of air transmitted to each of said combustion chamber and said catalytic combustor, said control means when in a first control state acting on said first airflow regulating means to maximize the air volume transmitted to said combustion chamber while simultaneously acting on said second airflow regulating means to reduce the air volume transmitted to said catalytic combustor.

8. Heating apparatus as defined in claim 5 wherein both of said first and second airflow regulating means are adjustable, and further including control means coupled to both of said first and second airflow regulating means for simultaneously adjusting them to simultaneously regulate the volume of air transmitted to each of said combustion chamber and said catalytic combustor, said control means when in a first control state acting on said first airflow regulating means to maximize the air volume transmitted to said combustion chamber while simultaneously acting on said second airflow regulating means to reduce the air volume transmitted to said catalytic combustor, and said control means when in a second control state acting on said first airflow regulating means to reduce the air volume transmitted to said combustion chamber while simultaneously acting on said second airflow regulating means to maximize the air volume transmitted to said catalytic combustor.

* * * * *